United States Patent [19]

Libis

[11] 4,173,440

[45] Nov. 6, 1979

[54] METHOD AND DEVICE FOR LUBRICATING COMPRESSORS

[75] Inventor: Fernand Libis, Illkirch Graffenstaden, France

[73] Assignee: Compagnie Industrielle des Telecommunications Cit-Alcatel, Paris, France

[21] Appl. No.: 913,924

[22] Filed: Jun. 8, 1978

[30] Foreign Application Priority Data

Jun. 17, 1977 [FR] France ..... 77 18646

[51] Int. Cl.[2] ..... F04C 29/02

[52] U.S. Cl. ..... 418/84; 418/98

[58] Field of Search ..... 418/97, 98, 99, 84, 418/87

[56] References Cited

U.S. PATENT DOCUMENTS

| | | | |
|---|---|---|---|
| 3,260,444 | 7/1966 | Williams et al. | 418/88 X |
| 3,462,072 | 8/1969 | Schibbye | 418/98 |
| 3,542,497 | 11/1970 | Chapuis | 418/84 |
| 3,556,697 | 1/1971 | Webb et al. | 418/98 |
| 3,876,345 | 4/1975 | Froeoe et al. | 418/84 |

*Primary Examiner*—William L. Freeh
*Assistant Examiner*—Leonard E. Smith
*Attorney, Agent, or Firm*—Sughrue, Rothwell, Mion, Zinn and Macpeak

[57] ABSTRACT

The invention consists of providing two lubrication circuits, a main circuit for lubricating the compression chamber and the various components of the compressor when operating under load and a secondary circuit for lubricating the components disposed on the suction side when opefating under no load.

The invention is used in air compressors.

8 Claims, 2 Drawing Figures

METHOD AND DEVICE FOR LUBRICATING COMPRESSORS

FIELD OF THE INVENTION

The present invention relates to a method of lubricating compressors in particular of the helical type.

BACKGROUND OF THE INVENTION

It also relates to a device for applying said method.

It is known that in compressors, the oil conveyed lubrication circuits performs several main functions:

Firstly, a heat-bearing fluid function for dissipating the heat which results from the compression of the fluid, for example air;

Secondly, a sealing function, by constituting viscous seals at the various leakage paths and internal points of play; and Thirdly, the actual lubrication function of the various components such as bearings, gear trains, friction seals and others.

With respect in particular to the heat-bearing function, it will easily be understood that the quantity of oil necessary for this purpose is a function of the quantity of heat to be dissipated, since the temperature of the air and oil mixture discharged by the compressor must be within a well-determined temperature range, with a view to preventing, firstly, condensation of water in the oil tank and secondly self-ignition of the air-oil mixture.

Thus when working under vacuum conditions the quantity of heat to be removed is less than when working under load and oil requirements are reduced.

The applicant has therefore sought to reduce the quantity of oil used under vacuum conditions, and to reduce the power then consumed by an even greater factor than in conventional compressors while using an oil circuit which is simple and highly reliable.

SUMMARY OF THE INVENTION

The invention therefore provides a method of lubricating a fluid compressor of the type which comprises a compression chamber in which at least two helical screws are made to rotate by at least one drive means and each rotates in two end bearings said bearings and drive means being housed in casings which act as a suction casing and a discharge casing, said drive means including a drive shaft, sealing of said shaft being provided on the suction side by a friction seal ring, characterized by the fact that, when operating under load, said compression chamber, said bearings, and said drive means, as well as said friction seal ring are fed with oil which comes from a separation tank at a high pressure which is substantially equal to that which prevails in said separation tank, while when operating under no load, said compression chamber and said bearings housed in said discharge casing are fed with oil coming from said separation tank, but at a low pressure, the bearings and said drive means as well as said friction seal ring housed in said suction casing being independently fed with oil coming directly from the exhaust or discharge end of the compressor and at a pressure slightly higher than atmospheric pressure.

The invention also provides a device for applying the method defined above, characterized by the fact that it comprises two circuits—a main circuit and a secondary circuit, said main circuit comprising a pipe coming from said oil separation tank and being subdivided into three branches, a first branch which feeds said compression chamber, a second branch which feeds said bearings, said drive means and said friction seal ring which are housed in said suction casing via a valve and a third branch which feeds said bearings housed in said discharge casing, said secondary circuit comprising a pipe which comes directly from the exhaust end of the compressor, communicating with a valve, then being subdivided into two branches, a first branch which feeds the bearings and the drive means housed in said suction casing, via a valve and a second branch which feeds said friction seal ring.

The disadvantages of the prior art and the advantages of the present invention will become more apparent from the following description given with reference to the accompanying drawings.

DESCRIPTION OF THE PRIOR ART AND THE PREFERRED EMBODIMENTS

Figure 1:
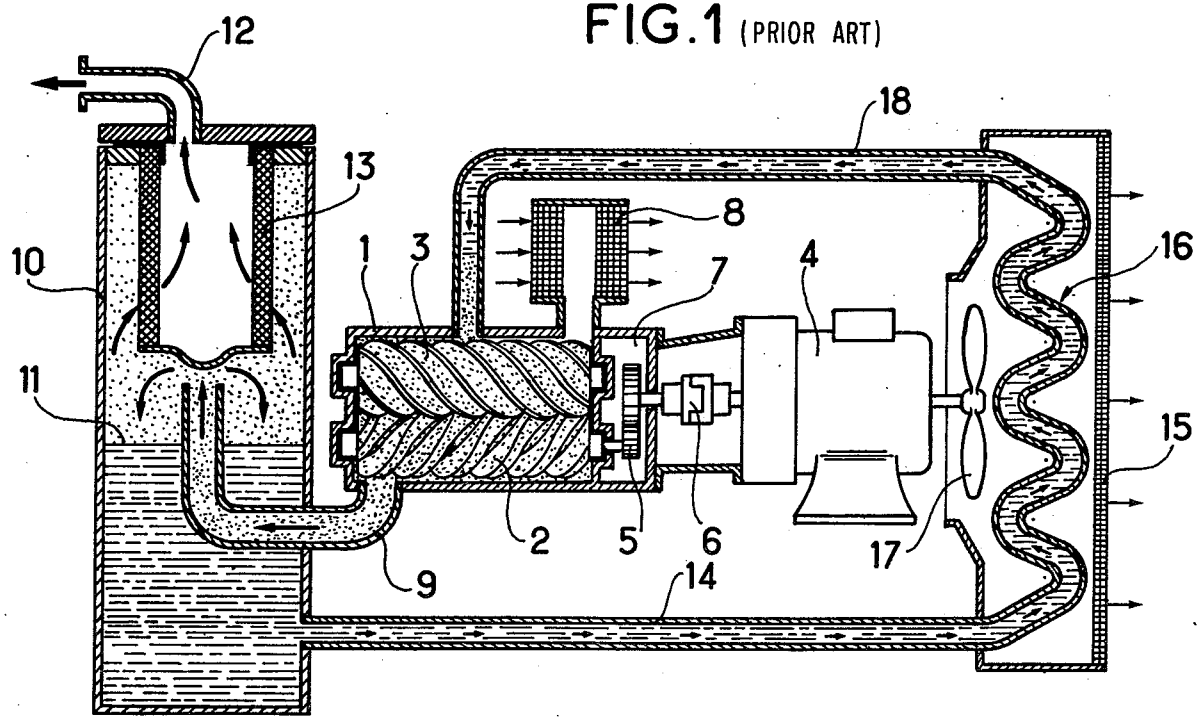
FIG. 1 (PRIOR ART)
FIG. 1 is a vertical section which shows a compressor lubricated in accordance with the prior art.

The compressor which is lubricated in known manner and shown in FIG. 1 comprises a compression block 1 in which two helical screws rotate a male helical screw 2 and a female helical screw 3. The male helical screw 2 is driven by a motor 4 and via gearing 5 which co-operates with a cardan joint 6, while casings such as 7 provide sealing.

Atmospheric air enters the block 1 via a filter 8 and after compression, escapes through a pipe 9. This pipe communicates with an oil separation tank 10 which is, of course, above the oil level 11. The compressed air is then conveyed towards the place where it is to be used via the pipe 12 in the direction of the arrows, after it has been separated from the particles of oil drawn off by a filter 13.

Lubrication is provided as follows:

When operating under full load the oil (which is under pressure from the air which comes from the pipe 9) passes along a pipe 14 and is then cooled in a cooler 15 by passing through coiled tubing 16 cooled by an air fan 17 which is driven by the motor 4. The oil thus cooled then passes along a pipe 18 to re-enter the compression block 1 where it is heated due to the compression of the air which then discharges it into the pipe 9 and so on.

It is easy to understand that, when operating under no load, the need for oil is not so great. Indeed, while the quantity of oil necessary for sealing and lubricating the components is practically independent from operating conditions, in contrast, the quantity of oil necessary for the heat-bearing function can be reduced when operating under no load.

For this purpose, the inlet of the filter 8 is therefore partially obstructed so as to reduce the pressure in the separation tank 10 and consequently the compression power.

However, the constraint resulting from the necessity of obtaining a sufficient oil flow with a view to performing the sealing and lubrication functions limits such a reduction in pressure, so that when operating under no load, the compressor still consumes about 35 to 40% of its power under load.

The Applicant has therefore attempted to remedy such a disadvantage and to reduce appreciably the power consumed when operating under no load, by using a simple, inexpensive and reliable extra lubrication circuit.

Therefore, such a lubrication method, as well as the device for applying this method, applied to an air compressor will be described with reference to FIG. 2, only by way of an illustration and having no limiting character.

Figure 2:
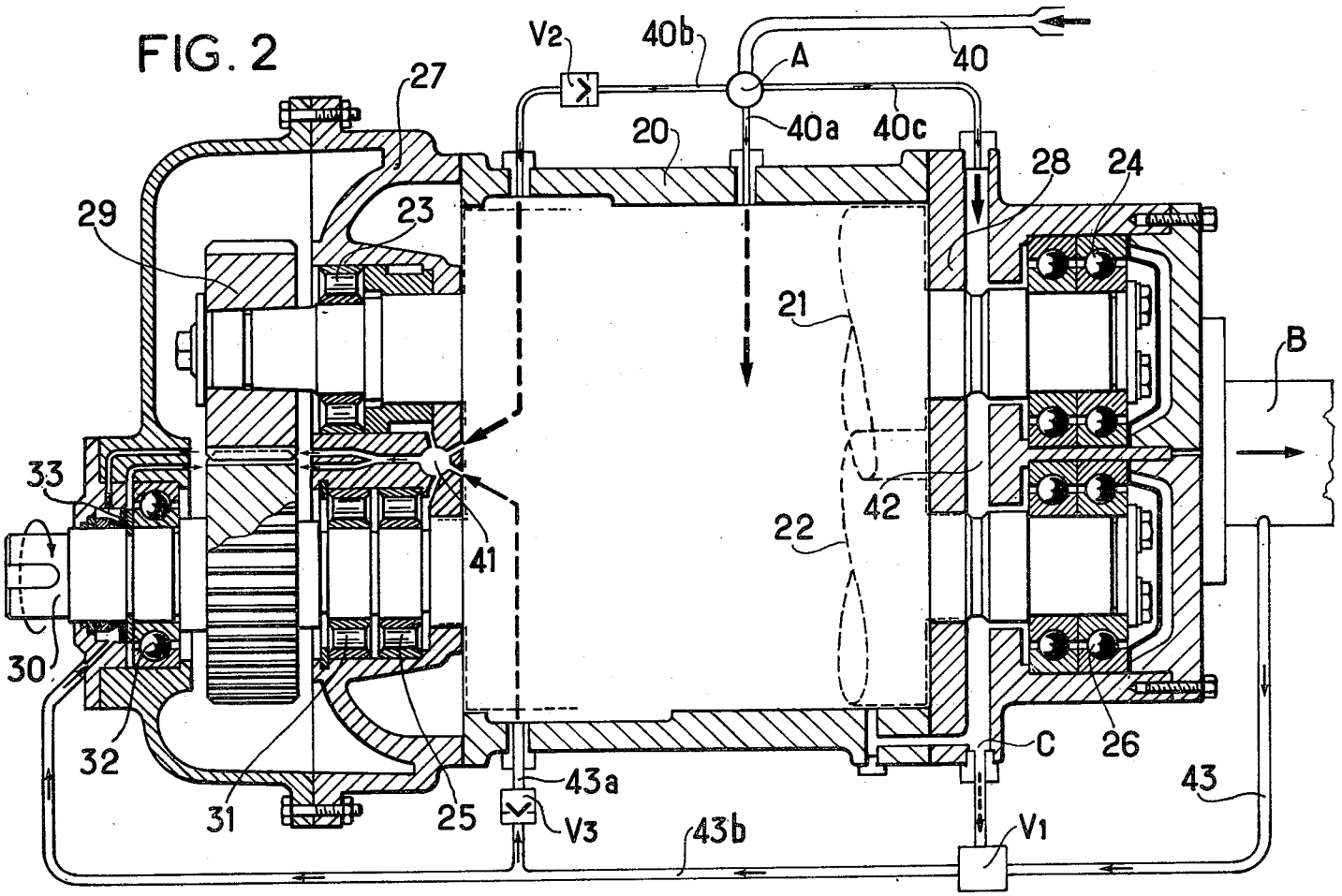
FIG. 2 is a transverse section which shows purely by way of illustration but having no limiting character a compressor lubricated in accordance with the invention.

The compressor shown in FIG. 2 includes a compression housing or block 20 inside which two helical screws rotate—a male helical screw 21 and a female helical screw 22. These helical screws rotate on ball or roller bearings, namely bearings 23 and 24 for the male helical screw 21 and bearings 25 and 26 for the female helical screw 22. Such bearings are housed in casings 27 and 28, the casing 27 acting as a suction casing, while the casing 28 performs the function of a discharge or exhaust casing.

The male helical screw 21 includes a shaft end (not shown) on which there is keyed a multiplying gear train 29 connected to a drive shaft 30 which rotates in bearings 31 and 32, sealing being provided by means of a friction seal 33.

Having thus described a compressor known per se, there will now be disclosed the invention whose advantages will become apparent from the present description.

Therefore, on referring to FIG. 2, it will be seen that the following components are to be lubricated permanently:

Firstly, the compression block 20, by an oil discharge which varies as a function of the compression power (heat-carrying function) but which is as low as possible with a view to providing sealing, Secondly, the bearings 23, 24, 25, 26, 31 and 32;

Thirdly, the multiplying gear train 29; and

Lastly, the friction seal.

The flow of oil necessary for these latter components must of course be substantially constant.

Taking into account the preceding considerations and in accordance with the invention, two lubrication circuits are provided—a main circuit and a secondary or extra circuit.

The main circuit comprises a pipe 40 coming from the separation tank, (not shown,) but which is analogous to the one referenced 10 in FIG. 1. This pipe 40 is subdivided at the point 4 into 3 branches or shunts:

A first branch 40*a* feeds the compression block 20;

A second branch 40*b* feeds the bearings 23, 25, and 31, the gear train 29 and the friction seal 33 by means of pipes such as 41 (this branch 40*b* can be opened or closed by a valve V2); and A third branch 40*c* which feeds the bearings 24 and 26 by means of a pipe 42;

The secondary circuit comprises a pipe 43 which comes from the discharge or exhaust casing B of the compressor. This pipe 43 communicates with a valve V1 controlled by the oil pressure at the point C. From the valve V1, said pipe 43 is subdivided into two branches or shunts:

A first branch 43*a* which feeds the bearings 23, 25 and 31, the gear train 29 and the friction seal 33 via the pipes 41; (this pipe is opened or closed by a valve V3); and A second branch 43*b* which feeds the friction seal 33 as well as the bearing 32.

Such lubrication circuits operate as follows:

When the compressor operates under load, the pressurea in the separation tank from which the pipe 40 comes is high, for example 7 to 10 bars according to the discharge rate. At the point A as well as at the point B, the pressure is also high and at the most 200 gr/cm$^2$ less than that which prevails in said separation tank. The result of this is that the oil passes along the branches 40*a*, 40*b* and 40*c* and feeds the compression chamber 20 as well as the various bearings, the gear train and the friction seal which have previously been described, at a high discharge rate, both on the suction side and on the discharge side.

Of course, the head losses in said pipes are predetermined so that the flow of oil will be sufficient.

when the compressor operates under no load, the pressure in the separation tank is relatively low and at the point B, it is about 20 gr/cm$^2$ higher than atmospheric pressure. It is also low at the point C. Consequently, the valve V1 opens and the oil conveyed by the pressure which prevails at the point B opens the valve V3 and lubricates the various components on the suction side via the branches 43*a* and 43*b*.

At the same time, the valve V2 has closed, but the oil still feeds the compression chamber 20 as well as the various components on the discharge side via the branches 40*a* and 40*c* evidently at a low but nevertheless sufficient discharge rate. It will be observed that the secondary lubrication circuit has high conductance, taking into account the relatively low pressure which prevails at the point B.

When the compressor again operates under load, the valves V1 and V3 close, the valve V2 opens and so on.

It is therefore seen that such lubrication in accordance with the invention makes it possible to feed the components on the suction side with oil at a low but sufficient pressure during operation under no load, this resulting in great saving of compression power.

Of course, it is not possible to obtain such an advantage with conventional lubrication systems which operate under no load at discharge pressures of 3 to 4 bars, this only reducing the consumption by 35 to 40% in relation to that under load. On the contrary, in accordance with the invention, the discharge pressure is reduced to a value slightly greater than atmospheric pressure by means of the secondary circuit, hence a great reduction in the compression power and in the consumption which is only 12 to 15% of the power under load.

In other words, in relation to conventional machines, the power under no load is divided by a coefficient which is at least equal to 2½.

I claim:

1. A method of lubricating a fluid compressor of the type comprising a suction casing, a discharge casing, means including said casings forming a compression chamber, bearings carried by said casings, at least two intermeshed helical screws supported by said bearings for rotation about their axes within said chamber, and at least one drive means for driving said helical screws, said drive means including a drive shaft, a friction seal ring for sealing of said shaft on the suction side thereof, said compressor further comprising an oil separation tank, and said compressor comprising suction and discharge ends, the improvement comprising the steps of:

feeding lubricating oil coming from said separation tank at high pressure which is substantially equal to that which prevails in said separation tank, when the compressor is operating under load, to said bearings, said drive means and said friction seal ring, and when said compressor is operating at no load, feeding said compression chamber and said bearings housed in said discharge casing with oil coming from said separation tank, but at a low pressure, and independently feeding said bearings and said drive means as well as said friction seal ring housed in said suction casing with oil coming directly from the discharge end of the compressor and at a pressure slightly higher than atmospheric pressure.

2. A device for lubricating a fluid compressor of the type comprising a suction casing, a discharge casing, means including said suction and discharge casings defining a compression chamber, bearings and drive means being housed in said casings, at least two helical intermeshed screws supported by said bearings for rotation about their axes within said chamber with said drive means being coupled to at least one of said helical screws, said drive means including a drive shaft, a friction seal ring being provided on the suction side for sealing of said shaft, said compressor further comprising an oil separation tank and having suction and discharge ends, and said method of lubrication comprising the steps of when operating under load, supplying oil from said separation tank at a high pressure to said compression chamber, said bearings, said drive means and said friction seal ring, and when said compressor is operating under no load, feeding said compression chamber and said bearings housed in said discharge casing with oil coming from said separation tank at low pressure and, independently feeding said bearings and said drive means as well as said frictional seal ring housed in said suction casing with oil coming directly from the discharge end of the compressor and at a pressure slightly higher than atmospheric pressure, said device comprising:

means defining two circuits, a main circuit and a secondary circuit, said main circuit defining means comprising a first pipe extending from said oil separation tank and being subdivided into three branches, a first branch for feeding said compression chamber, a second branch for feeding said bearings, said drive means and said friction seal ring housed in said suction casing, a valve within second branch, and a third branch for feeding said bearings housed in said discharge casing, and wherein said means defining said secondary circuit comprises a second pipe extending directly from the discharge end of the compressor, said second pipe bearing a valve and being subdivided downstream of said valve into two branches, a first secondary circuit branch feeding the bearings and the drive means housed in said second suction casing, via a secondary circuit first branch valve and a second branch for said secondary circuit feeding said friction seal ring.

3. The device according to claim 2, wherein said secondary circuit is of high conductance.

4. The device according to claim 2, wherein said compressor further comprises means when operating under no load for closing the valve of the second branch of the main circuit and for opening the valve of the first branch of the secondary circuit.

5. The device according to claim 4, wherein said means for opening and closing of the valves comprise means responsive to oil pressure dependent upon the operational mode of the compressor.

6. The device according to claim 2, further comprising means for opening the valve of said branch of the main circuit when the compressor operates under load and for closing the valve of the second pipe of said secondary circuit.

7. The device according to claim 6, wherein said means for opening and closing of said valves comprise means responsive to oil pressure dependent upon the operational mode of the compressor.

8. The device according to claim 6, further comprising means for closing the valve of the second branch of the main circuit when the compressor operates under no load and for opening the valve of the first branch of the secondary circuit.

* * * * *